US005105913A

United States Patent [19]

Neubauer et al.

[11] Patent Number: 5,105,913

[45] Date of Patent: Apr. 21, 1992

[54] TILT MECHANISM FOR PORTABLE HOIST

[75] Inventors: Willibald Neubauer, Seattle; Allen L. Luft, Bellevue; Michael C. Burkey, Woodinville, all of Wash.

[73] Assignee: Genie Industries, Inc., Redmond, Wash.

[21] Appl. No.: 737,380

[22] Filed: Jul. 29, 1991

[51] Int. Cl.[5] ..... B66B 9/20

[52] U.S. Cl. ..... 187/9 E; 182/148

[58] Field of Search ..... 187/9 E, 9 R, 11, 94; 182/148, 63, 112, 141, 145, 103; 254/4 R, 4 B, 4 C, 143

[56] References Cited

U.S. PATENT DOCUMENTS

| | | | |
|---|---|---|---|
| 4,015,686 | 4/1977 | Bushnell, Jr. | 187/9 E |
| 4,458,785 | 7/1984 | Bushnell, Jr. | 187/9 E |
| 4,529,063 | 7/1985 | Kishi | 187/9 E |

*Primary Examiner*—Joseph E. Valenza
*Assistant Examiner*—Kenneth Noland
*Attorney, Agent, or Firm*—Seed and Berry

[57] ABSTRACT

A portable telescopic hoist has an auxiliary tilt-back frame at the rear for supporting the hoist when it is tilted from its normal upright position to a backward sloped position to clear an overhead restriction. The tilt-back frame has a strut with a gas spring therein having a nearly constant spring force. This strut has a downwardly sloped operating position from a detachable connection at the back of the mast of the hoist.

7 Claims, 5 Drawing Sheets

TILT MECHANISM FOR PORTABLE HOIST

DESCRIPTION

1. Technical Field

The present invention relates to portable hoists with telescopic mast for raising a work platform, and more particularly to means for tilting and handling the hoist to assist movement thereof between work sites.

2. Background of the Invention

Portable hoists of the type having a telescopic mast mounted on a base having front and back sets of wheels and outriggers, such as shown, for example, in U.S. Pat. Nos. 4,015,686 and 4,458,785, need to be tilted rearwardly in order to be moved through doorways or other areas with height restrictions to or from a work site. In the past, a tilt-back frame with rear wheels has been used to function with the rear wheels on the hoist base as a temporary support for the hoist when it is tilted back on the rear wheels of the hoist base until the wheels on the tilt-back frame are in ground engagement. This requires that a strut or the like connect the back of the tilt-back frame to the mast partway up the mast, and preferably this strut is adjustable in length to adjust the tilt-back angle of the mast sufficiently for the needed overhead clearance. It is also necessary for convenient use of the hoist that the tilt-back frame be adapted to be moved into an upright storage position at the back of the mast.

In the past, the strut between the mast and the tilt-back frame has commonly incorporated a manually operated jack screw for adjusting the tilt-back angle of the mast after the wheels on the rear of the tilt-back frame are in ground engagement. This jack screw arrangement requires operator time for turning it to selectively retract and extend the effective length of the strut, and does not provide any counterbalancing force when the mast is tilted to assist in returning the mast to an upright position.

SUMMARY OF THE INVENTION

The present invention improves the tilt-back operation of the above-described type of hoist by providing a strut employing a gas spring having shock absorbing characteristics which is matched to the weight and retracted height of the mast so that it changes little in force when compressively loaded responsive to backward tilting of the mast. The resulting compression of the gas spring provides a counterbalancing force to subsequently assist manual tilting of the mast forwardly into its normal operating position.

The present invention also provides an improved convenient arrangement for manipulation of a fulcrum bar on the tilt-back frame which can be used when the tilt-back frame is in storage position, to assist during lifting of the hoist upwardly into horizontal position on the bed of a transport vehicle by resting the fulcrum bar on the vehicle bed, swinging the hoist upwardly on the fulcrum bar, and then sliding the hoist further onto the bed relative to the fulcrum bar.

DETAILED DESCRIPTION OF THE INVENTION

Figure 1:
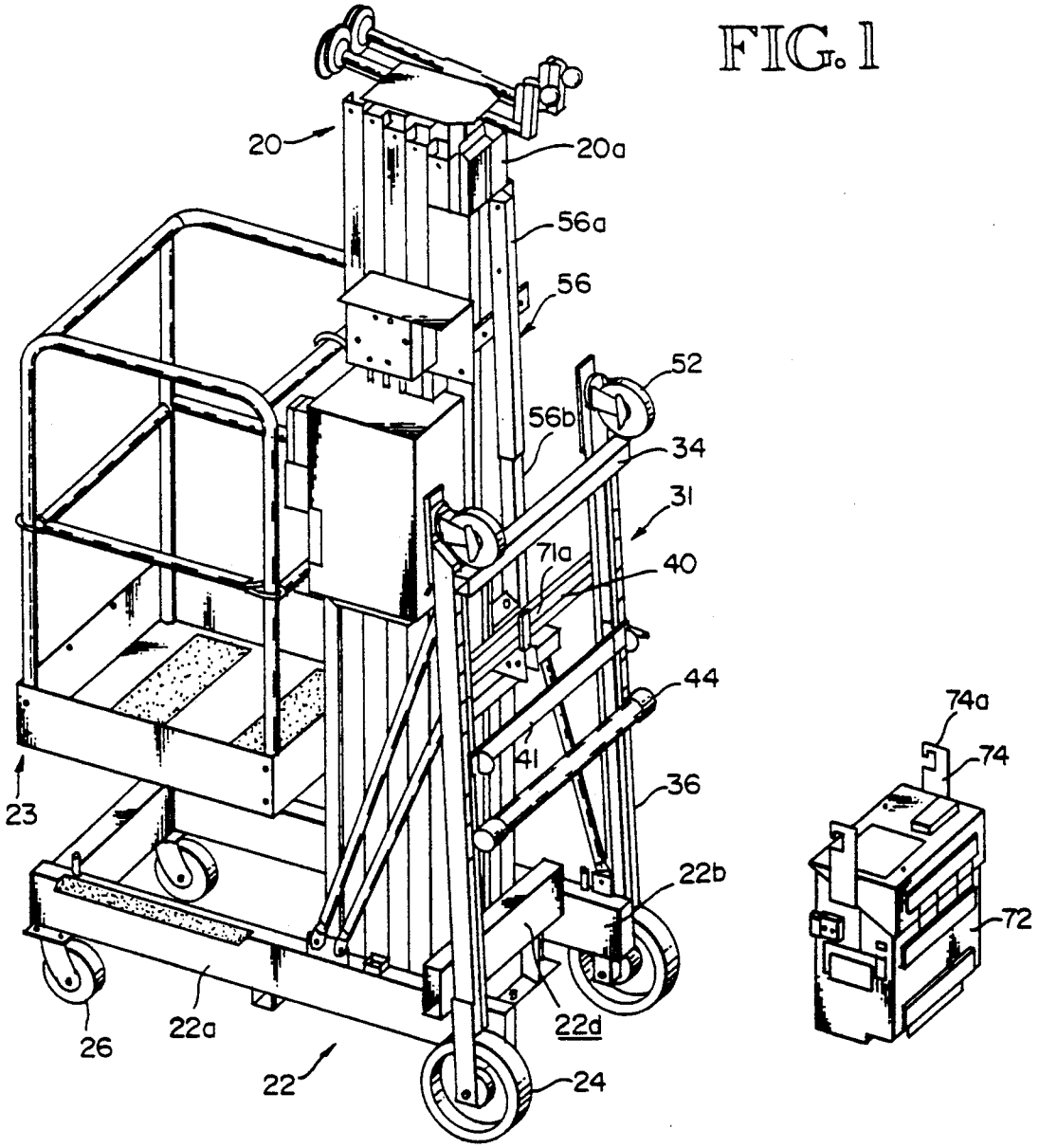
FIG. 1 is a perspective rear elevational view of a hoist embodying the present invention, and shown in lowered position with the battery holder detached.

Referring to the drawings, the invention is illustrated applied to a hoist having a telescopic multi-stage mast 20 rigidly supported on a base frame 22 and carrying a work platform 23 at the front. This hoist is portable by way of a pair of axially aligned back wheels 24 and a pair of front casters 26. To lend stability to the hoist, there are provided front, back, right, and left extending outriggers 28*a–d*, respectively, which are detachably received in elongated socket members 22*a–d* comprising structural parts of the base frame 22. At their outer ends, the outriggers have screw jacks 30 for leveling. The mast 20 has its telescopic sections slideably interfitting front to back with respect to a fixed rear base section 20*a* and may be constructed as shown in U.S. Pat. No. 4,458,785. For purposes of the following discussion, the base frame 22 and fixed bottom mast section 20*a*, together with the related bracing, will be considered as parts of a base frame assembly. As is well known in the art, the mast may be raised by action of a hydraulic cylinder provided with pressurized oil by an electrically driven pump.

A tilt-back assembly 31 has a frame 32 swing-mounted on the axles 34 for the back wheels 24 of the base frame 22 by way of forward extensions 36*a* on longitudinal channels 36 which are cross-connected by a rear cross-member 38 and an intermediate cross-member 40. The channels 36 function as tracks 36*b*, as well as structural members, and receive a front set of interconnected carriages 42 and a back set of adjustable stop carriages 43 interconnected by a cross-member 41.

The front carriages 42 each comprise a pair of wheels 42*a*, 42*b* journal-mounted on stub shafts which extend through a carriage element 42*c*. The stub shaft for the wheels 42*b* has an inner catch extension 42*d*. The carriage elements 42*c* are rigidly cross-connected by a fulcrum bar 44 which thereby becomes movable along the tracks 36*b* from front stop bolts 45 extending through the channels 36 to rear catch hooks 46 on the back stop carriages 43. The hooks 46 are each freely swing-mounted on a bolt 46*a* at the front of a respective stop carriage member 43*a* onto which a pair of wheels 43*b*, 43*c* are journal-mounted to ride in the tracks 36*b*. The cross-member 41 is connected to the carriage members 43*a*, and the location of the latter 43 along the tracks 36*b* is set by spring pins 48 which extend through laterally extending brackets 49 on the cross-member 41. These pins 48 are arranged to selectively engage a row of holes provided on the back side of the channels 36.

The tilt-back frame 32 has rearwardly projecting mounts 50 for a pair of swivel casters 52 located behind the rear cross-member 38. These casters 52 complement the back wheels 24 on the base frame 22 when the tilt-back assembly 31 is in operation.

Figure 5:
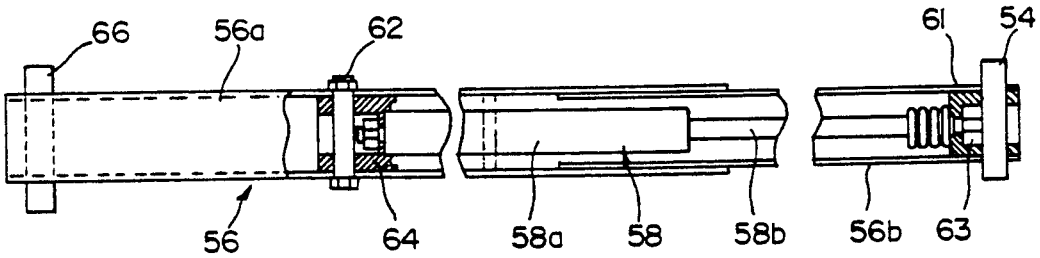
FIG. 5 is a longitudinal vertical section view through the telescopic strut assembly.

Extending from a pivotal bolt connection 54 with the cross-member 40 is a telescopic strut 56 having interfitting front and back slide tubes 56*a*, 56*b* which may be of square cross-section. Mounted within the slide tubes 56*a*, 56*b* is a gas spring 58 (FIG. 5) having a sealed cylinder 58*a* and a piston rod 58*b*. The gas spring 58 provides a spring force which is relatively constant throughout its full stroke, i.e., the spring force varies only about 15% during extension and retraction of the piston rod 58*b*.

The opposite ends of the gas spring 58 are connected to hollow adapters 60, 61 which are respectively secured in place within the slide tubes 56*a*, 56*b* by a cross-bolt 62 extending through the larger tube 56*a*, and by the pivot bolt 54. The connection of the gas spring 58 to the adapters may be by way of a nut 63 on a threaded outer end portion of the piston rod 56*b* and a nut 64 on a threaded stud extension 58*c* on the cylinder 58*a*. The piston rod 56*b* and the extension 56*c* project through bores in opposed end walls of the adapters 60, 61.

At its forward end, the strut 56 has a cross-pin 66 projecting from opposite sides of the strut tube 56*a* for fitting into bayonet slots 67 provided in a pair of latch brackets 68 mounted on a cross-member 69 at the back of the rear base section 20*a* of the mast. The pin 66 is retained in the slots 67 when the tilt-back assembly 31 is in operating position. The tilt-back assembly 31 has an upright storage position (FIG. 1) in which the strut 56 is released from the latch brackets 68 and occupies a position resting against the backside of the base section 20*a* of the mast above the cross-member 69 and engaged near its then upper end by a rest bracket 70 on the rear cross-member 38 of the tilt-back frame 32. A removable cross-pin keeper 71 extending between the brackets 68 retains a central extension 71*a* on the underside of the cross-member 40 to hold the tilt-back assembly in its upright storage position.

Figure 3:
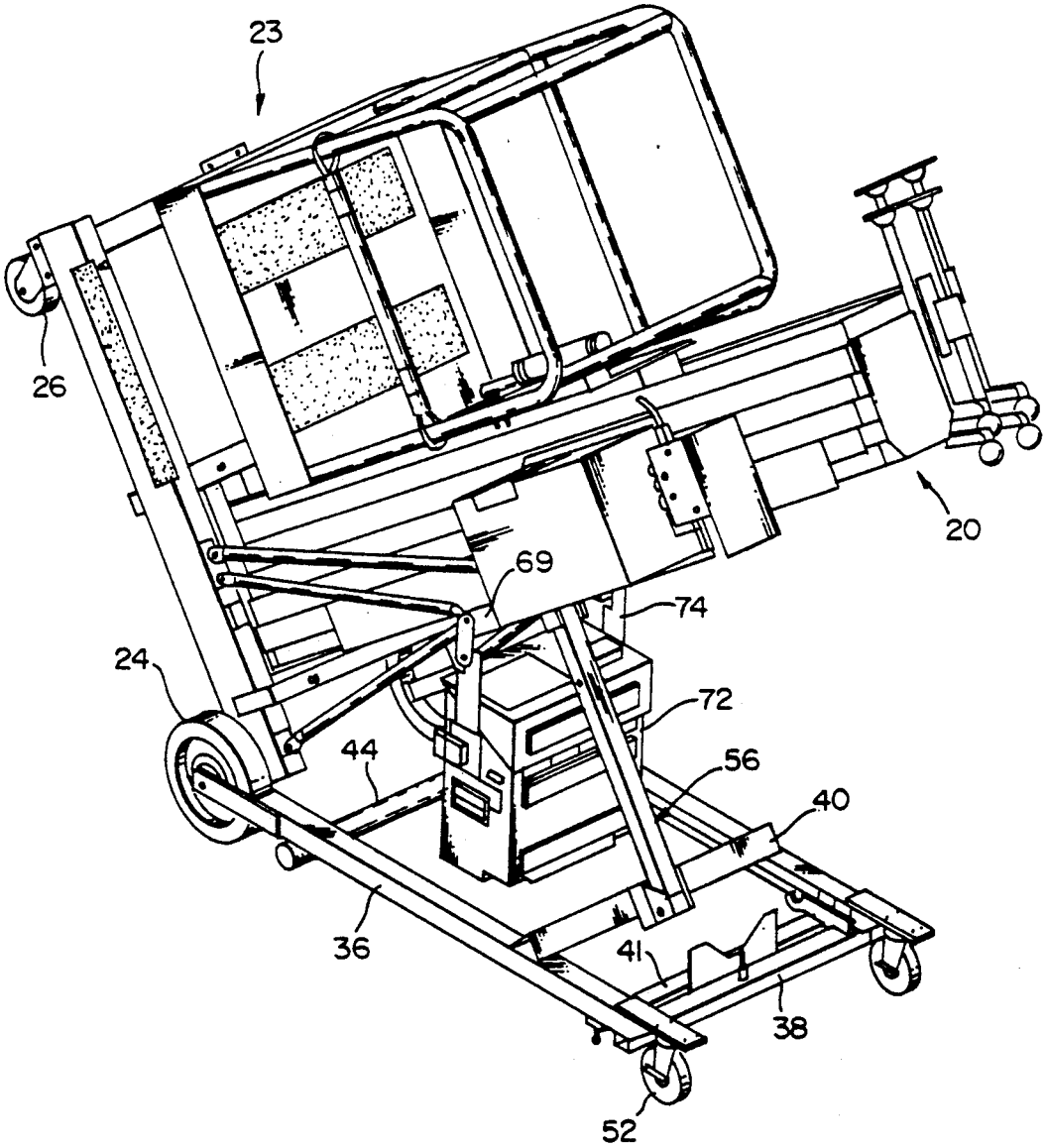
FIG. 3 is a perspective rear elevational view showing the hoist in tilted back position.
Figure 4:
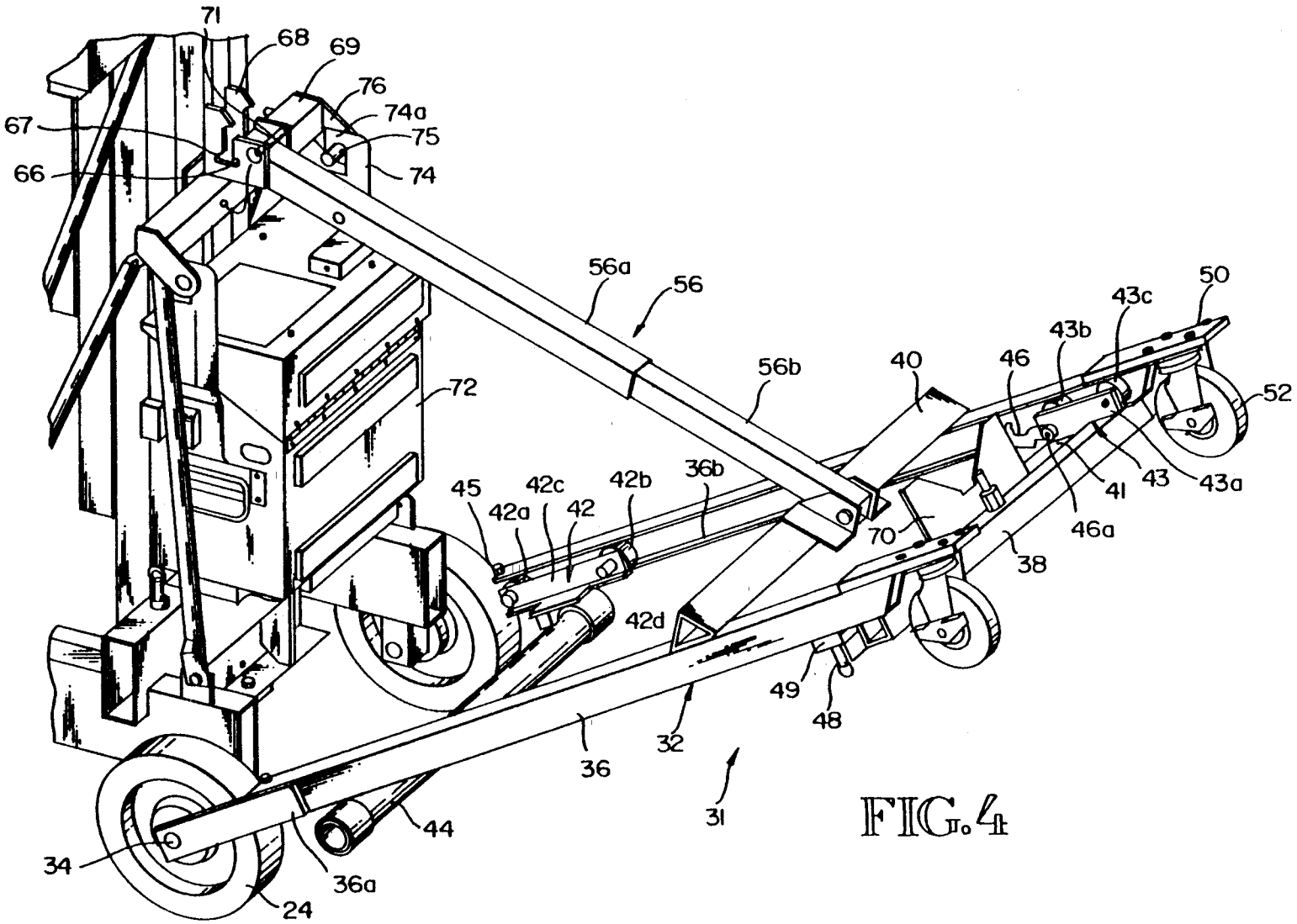
FIG. 4 is a fragmentary, enlarged perspective rear elevational view of the hoist prepared for tilt back as in FIG. 2.

When the electrical power source for operating the hoist is a storage battery, it is preferred to provide a battery holder 73 which is swing-mounted at the back of the hoist by a pair of upright swing arms 74 which have hooks 74*a* at their upper end. These hooks engage pivot pins 75 projecting from arms 76 on the ends of the cross-member 69 so that when the hoist is tilted back onto the tilt-back assembly 31, the battery 72 remains in upright position as shown in FIG. 3. The described arrangement makes it convenient to remove the battery and its holder 73 as a unit from the hoist as indicated in FIG. 1, when the hoist is being transported in a horizontal position on a transport vehicle.

When the hoist is to be transported on a vehicle bed such, for example, on the bed of a pickup truck, the position of the catch hooks 46 is set by way of adjustment of the location of the spring pins 48 along the channels 36, so that when the catch extensions 42*d* are engaged with the catch hooks 46, the fulcrum bar 44 will be slightly higher than the truck bed. Then the fulcrum bar 44 is rested on the truck bed and the entire hoist is manually swung upwardly on the fulcrum bar until the mast occupies a generally horizontal position. Leverage for assisting this upward swinging of the hoist may be increased by having the front outrigger 28*a* mounted in the socket member 22*a*. After the hoist has been swung into horizontal position, it can be rolled onto the truck bed by use of the casters 52 with the fulcrum bar 44 remaining stationary relative to the truck bed by way of the channels 36 riding on the wheels 42*a*, 42*b* of the carriages 42.

Figure 2:
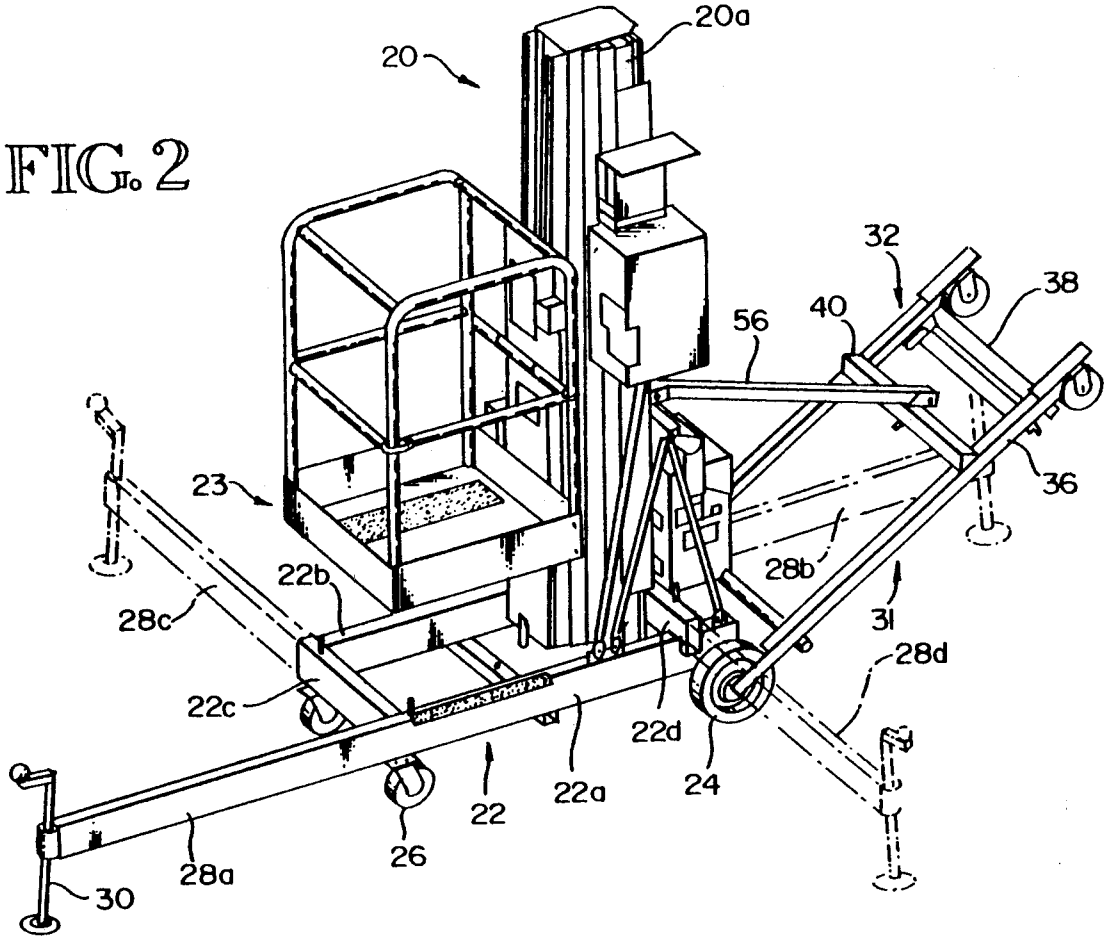
FIG. 2 is a perspective front elevational view of the hoist prepared for tilt back.

Referring to FIG. 2, the hoist is shown in preparation for manipulating it to pass through a doorway, for example, having a height less than the height of the top of the mast 20. The pin 71 is removed to release the tilt-back assembly 31 to swing downwardly on the axles 34 from its upright storage position (FIG. 10 to its sloped operative position maintained by the gas spring 58 in the strut 56. The outriggers 28*b*, *c* and *d* are removed and the front outrigger is preferably left in its socket member 22*a* to give added leverage for then manually tilting the hoist rearwardly on the axles 34 of the rear wheels 24 until the caster wheels 52 of the tilt-back assembly 31 are brought into ground engagement (FIG. 3). During this tilting operation the battery remains vertical by way of pivoting of the holder hooks 74*l* on the pins 75. The front outrigger 28*a* is then removed and stowed with the other outriggers on suitable brackets on the mast. The reduced height of the mast in its tilted back position makes it possible to them wheel the unit through the doorway.

It will be appreciated that when the hoist is tilted back so that it is supported by the rear wheels 34 and casters 52 on the tilt-back assembly 31 as shown in FIG. 3, the gas spring 58 in the strut 56 is loaded in compression and acts as a shock absorber as well as exerting a return counterbalancing force which is nearly constant during the tilting back of the hoist from its normal upright position. This counterbalancing force assists in manually returning the hoist to its upright operating position after it has been moved through the doorway. It will be appreciated that the gas spring 58 can be complemented by a concentric compression coil spring where appropriate.

We claim:

1. A hoist comprising:

a base frame having primary transport wheels thereon including a pair of back wheels having a rotation axis defining a horizontal tilt axis;

a mast rigidly mounted on said base frame;

a tilt-back frame having secondary transport wheels thereon remote from said back wheels and swing-mounted on said base frame to swing on said tilt axis from an upright storage position adjoining said mast to a support position forming an acute angle with said mast; and a telescopic strut unit pivotally mounted at a lower end to said tilt-back frame and having a pivotal connection at an upper end with said mast, said strut unit having a gas spring controlling the telescoping of said strut;

said mast, base frame, and tilt-back frame being adapted to be manually tilted rearwardly as a unit about said tilt axis until said secondary transport wheels contact the ground whereupon further rearward tilting of the mast and base frame unit exerts a compressive force on said gas spring and shortens said strut to thereby lower the elevation of the top of the mast so that the mast can be wheeled on said back wheels and secondary wheels along a travel path having restricted overhead clearance.

2. A hoist according to claim 1 in which the pivotal connection of said strut unit with said mast is detachable when said secondary wheels are not in ground engagement, said strut having an upright storage position at the back of said mast when its upper end is detached from its said pivotal connection with the mast.

3. A hoist according to claim 1 in which said tilt-back frame provides a pair of tracks at opposite sides thereof, a fulcrum bar extending parallel to said tilt axis and slideably mounted on said tracks for forward and backward movement between a storage position adjacent said secondary transport wheels to an active position adjacent said back wheels.

4. A hoist according to claim 3 in which said tilt-back frame has catch hooks adjacent said secondary transport wheels adapted to retain said fulcrum bar when said tilt-back frame is in an upright storage position, and to release the fulcrum bar when the tilt-back frame and mast have been swung upwardly on said fulcrum bar to a generally horizontal position when the fulcrum bar is resting on a support.

5. A hoist according to claim 1 in which said base frame has a longitudinal outrigger socket open at the front of the base frame, and a front outrigger for said socket to act as a lever arm for assistance in tilting said mast, base frame, and tilt-back frame as a unit about said swing axis.

6. A hoist according to claim 1 in which a battery holding unit is swingably mounted at the back of said mast on a battery swing axis parallel to said tilt axis so that a battery mounted in said holding unit will remain level while said mast is being tilted backwardly.

7. A hoist according to claim 1 in which said gas spring reduces in length than about 15" while subject to said compressive force.

* * * * *